United States Patent [19]

Brown et al.

[11] Patent Number: 4,794,813

[45] Date of Patent: Jan. 3, 1989

[54] ADJUSTABLE HYDRAULIC CONTROLS FOR EARTH-MOVING EQUIPMENT

[75] Inventors: Thomas R. Brown, Plainfield, Ill.; Ronald C. Natzke, Burlington; Richard H. Logan, West Burlington, both of Iowa

[73] Assignee: J. I. Case Company, Racine, Wis.

[21] Appl. No.: 66,743

[22] Filed: Jun. 25, 1987

[51] Int. Cl.[4] ..... G05G 1/04; G05G 5/18

[52] U.S. Cl. ..... 74/491; 74/522; 74/525; 74/533; 74/571 M; 180/334

[58] Field of Search ..... 74/491, 510, 522, 535, 74/571 M; 180/315, 326, 334

[56] References Cited

U.S. PATENT DOCUMENTS 3,242,763 3/1966 Bulhwald ..... 74/522 X
3,373,661 3/1968 Reichard ..... 74/522 X
4,348,916 9/1982 Shimano ..... 74/522 X
4,505,166 3/1985 Tesar ..... 74/522 X
4,611,500 9/1986 Nagano ..... 74/522 X

*Primary Examiner*—Allan D. Herrmann
*Attorney, Agent, or Firm*—Peter N. Jansson, Ltd.

[57] ABSTRACT

An improved adjustable control device for multi-lever hydraulic controls on earth-moving equipment, which conveniently and easily positions the control levers to accommodate different operators. The device includes a pair of spaced supports, a pair of axially aligned end members each movably mounted on one of the supports, a main shaft extending between the end members used for pivot mounting of the levers, and a device to adjust the end members on the supports. Parts are positioned and arranged such that end member adjustment moves the main shaft vertically, which in turn moves the range of control lever motion force or aft as desired.

14 Claims, 3 Drawing Sheets

ADJUSTABLE HYDRAULIC CONTROLS FOR EARTH-MOVING EQUIPMENT

FIELD OF THE INVENTION

This invention is related generally to hydraulic control mechanisms for earth-moving equipment and the like and, more particularly, to multi-function control devices typically having a plurality of control levers the range of motion of which may be adjustably positioned to accommodate the requirements of an operator.

BACKGROUND OF THE INVENTION

Earth-moving equipment, such as backhoes and other devices having booms and digging buckets and the like, typically have a number of hydraulic valves which are individually operated to control various motions. Such devices usually have a plurality of control levers arranged in more or less side-by-side fashion at a position adjacent to an operator's chair.

The operator usually is sitting in the chair during operation of the earth-moving equipment, manipulating the several control levers. Constant and varied lever movements are required—pushing and pulling them fore and aft to extend and retract the boom, raise and lower the boom, tilt the bucket, etc., in order to successfully and efficiently move earth.

Because of this complexity of operation and because such equipment frequently is operated for long periods of time, it is highly desirable that the range of motion of the control levers be at a comfortable and convenient position with respect to the position of the operator. Sometimes an operator finds that readjustment of the control lever positions is helpful after long operation in one relative position.

And, since operators of different physical sizes and shapes operate the equipment, the position of the control levers with respect to the seat frequently is improper for the person preparing to operate the equipment. For example, a short operator may have difficulty reaching the full range of motion of the control levers with his arms unless he slides forward on the seat. And long armed operators have the same sorts of problems related to ease and comfort during use.

In the past, hydraulic control levers for earth-moving equipment have been made adjustable in various ways. For example, an entire control console has been made tiltable or slidable toward or away from an operators position. Adjustment of such devices, however, may be difficult, sometimes requiring tools and sometimes requiring more effort than seems justified. With adjustment difficulties, frequent adjustment is avoided, and this leads to discomfort and a reduced productivity.

In some cases, major adjustments of the position of the range of control lever motion may be particularly difficult.

There has been a need for an improved adjustable multi-lever hydraulic control device for earth-moving equipment which will quickly and easily adjust the position of the range of motion of hydraulic control levers, and thus conveniently accommodate the needs of particular operators.

OBJECTS OF THE INVENTION

It is an object of this invention to provide an improved earth-moving equipment control device overcoming some of the problems and shortcomings of the prior art.

Another object of this invention is to provide an improved adjustable hydraulic control device which may be easily and quickly adjusted to accommodate different operators.

Another object of this invention is to provide an improved adjustable hydraulic control device the range of motion of which may be substantially adjusted without difficulty.

Another object of this invention is to provide an improved adjustable control device which may be adjusted with only simple movement of an adjustment lever without the need for tools.

These and other important objects will be apparent from the descriptions of this invention which follow.

SUMMARY OF THE INVENTION

This invention is an improved adjustable control for earth-moving equipment having at least one and usually several levers to operate hydraulic valves. The device is of the type with control levers mounted on a shaft to pivot thereabout as lever grip ends (usually upper ends) are moved back and forth. The shaft is usually horizontal and oriented such that the lever upper ends move fore and aft. Such pivoting raises portions of lower ends of the levers to move upright links which are pivotably secured to the lever lower ends and extend to the valves. The improved adjustable control device of this invention quickly and easily repositions the control lever range of motion to accommodate the operator.

The invention includes a pair of spaced supports, a pair of axially aligned end members each movably mounted on one of the supports, a main shaft secured to and extending between the end members with the control levers attached thereto by their pivot mounts, and means to adjust the end members on the supports.

The arrangement of the movable mounting of end members on supports and the positioning of the main shaft on the end members are such that end member adjustment moves the main shaft vertically. Given the pivotable engagement of the control levers with the main shaft and their pivotable attachment to the upright links which extend to the hydraulic valves, this vertical movement of the the main shaft serves to move the range of motion of the lever upper ends fore or aft by a substantial distance, as necessary. Such adjustment in the positions of the upper ends of the control levers accommodates the needs of various operators.

In preferred embodiments, the movable mounting of each end member on its corresponding support includes means on the support limiting and defining the movement of the end member with respect to its support. The movement of the end members, primarily that portion mounting the main shaft, is preferably through an arc.

In the most preferred embodiments, each end member is rotatable with respect to its support about an axis parallel to and offset from the axis of the main shaft. The end members are preferably plates having circular edges, with their corresponding supports having annular edges rotatably engaging such circular edges to provide the rotatable mounting.

The main shaft extends between the two round plates at an eccentric, that is, a substantially off-center position. At least one of the plates is most preferably substantially coplanar with the support on which it is rotatably mounted.

In certain preferred embodiments, the means for adjustment of the end members includes an adjustment arm affixed to one of the end members. When the end members are round plates, as preferred, the adjustment arm preferably extends beyond the circular edge to a handle portion spaced sufficiently from the rotational center of the plates to allow good leverage for the most easy adjustment of the rotational positions of the plates on their supports.

Means are preferably provided on the support to engage the adjustment arm to hold it and the plate (or other end member) in a selected position of adjustment with respect to such support. Such engagement means is preferably along the top edge of the support having the plate to which the adjustment arm is mounted. In certain preferred embodiments, such top edge is preferably parallel to the circular edge of the plate. In the most preferred embodiments, notches are spaced along the top edge of the support in position to be selectively engagable by a portion of the adjustment arm.

As noted, the plate to which the adjustment arm is attached is preferably substantially coplanar with the support on which it is rotatably mounted. In such cases, the adjustment arm is preferably a flat strip against such coplanar plate and support and overlying the notched top edge of the support. Such flat adjustment arm strip preferably has a tab projecting from it toward the notches along the top edge of the support to engage one of the notches and thus hold the device in a selected position of adjustment.

DETAILED DESCRIPTIONS OF PREFERRED EMBODIMENTS

Figure 1:
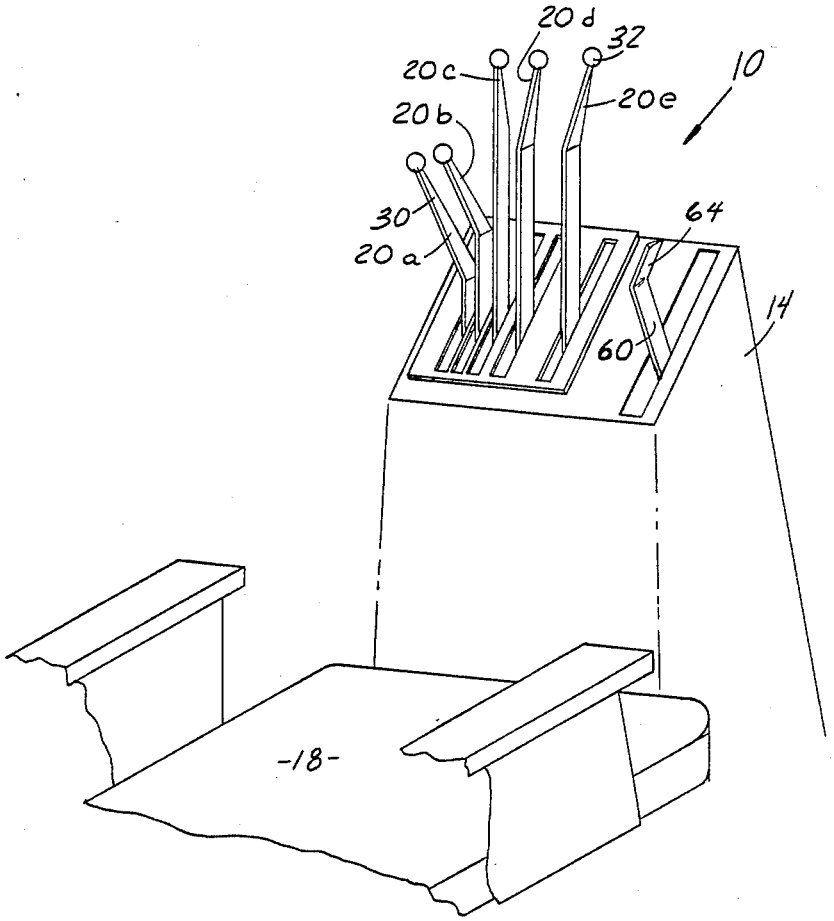
FIG. 1 is a fragmentary perspective view of a preferred hydraulic control device, with most elements of the invention covered by a housing, illustrating the position of a group of control levers adjacent to the seat of an earth-moving vehicle.

The drawings illustrate a preferred control device 10 for earth-moving equipment, such as a backhoe, in accordance with this invention. Control device 10, most of the parts of which are covered by a housing 14, and an operator's seat 18 which is adjacent to control device 10 are both part of the earth-moving equipment. Typically, the earth-moving equipment is a wheeled vehicle.

Control device 10 includes five generally L-shaped control levers 20*a* through 20*e*. Fore-and-aft pivoting movements of control levers serve to control various functions of the earth-moving equipment, such as vertical movement of a boom, extension and retraction of a boom, and the position of a digging bucket, as is well known. Each of the control levers 20*a* through 20*e* has an opening 22 by which it is pivotably mounted on a horizontal main shaft 24 which extends between first and second floor-mounted standards 26 and 28, as more fully described later.

Each of the levers 20*a* through 20*e* has an upper end portion 30, to which a knob 32 is secured, and a lower end portion 34. Upper ends 30 are exposed above housing 14 in position to be moved by hand in fore-and-aft directions. Lower ends 34 are inside housing 14.

Lower end 34 of each control lever includes pivot mount opening 22 which receives main shaft 24. Such pivot mounting is located near the juncture of the two portions, one substantially upright and the other substantially horizontal, which form the L-shaped configuration of each of the levers 20*a* through 20*e*. The lower ends 34 of the control levers, near the very ends thereof, are each secured to one of a plurality of upright control rods or links 38 by means of pivot connectors 42, all in known manner. Control rods 38 extend from their attachments to lower ends 34 downwardly to hydraulic control valves located well below the level of the vehicle floor.

The operation of control device 10 in any given position of adjustment is well-known. Control levers 20*a* through 20*e* are first-class levers which pivot about main shaft 24 to raise and lower upright rods 38 and thus operate the hydraulic valves of the earth-moving equipment.

L-shaped control levers 20*a* through 20*e*, main shaft 24, and the pivot connections of the levers with upright rods 38 are configured, positioned, and arranged such that fore-and-aft movement of control levers 20*a* through 20*e* imparts vertical motion to upright rods 38. When upper end 30 of a control lever is pulled toward the operator, the corresponding upright rod 38 is pulled up; when a control lever is pushed away from the operator, control rod moves down. All of this is well-known in the art.

First and second plates or end members 46 and 50 are rotatably mounted to first and second standards 26 and 28, respectively, near the top ends thereof. Thus, standards 26 and 28 serve as supports for plates 46 and 50, and are often referred herein as supports.

Each of plates 46 and 50 is substantially coplanar with the support 26 or 28 to which it is mounted. Each plate 46 and 50 has a circular edge 54 and the support 26 or 28 to which it is mounted has a corresponding annular edge 58. Each annular edge 58 rotatably engages a circular edge 54. Annular edges 58 cooperate with circular edges 54 to provide means on supports 26 and 28 to limit and define the movement of plates 46 and 50, in this embodiment such movement being rotation of plates 46 and 50 along an arc.

First and second plates 46 and 50 are aligned along a common horizontal axis which is parallel to the horizontal axis of main shaft 24. First and second plates 46 and 50 are each rotatable about the axis along which they are aligned.

As shown in the drawings, main shaft 24 is eccentrically mounted to first and second plates 46 and 50. Main shaft 24 is on plates 46 and 50 in a position such that its arc of movement during rotational adjustment of plates 46 and 50 has a dominant vertical component. That is, rather than being attached and movable primarily near the top or bottom portions of plates 46 and 50, main shaft 24 is attached at a lateral position such that its arc of movement during adjustment spans a lateral portion of such plates. In this embodiment, the motion of main shaft 24 is approximately between the 7:30 and 9:30 positions of a clock.

Thus, the main shaft 24 and the movable mounting of plates 46 and 50 on supports 26 and 28 are positioned and arranged such that movement of plates 46 and 50 during adjustment substantially changes the vertical position of main shaft 24. With this configuration and arrangement of parts, rotation of plates 46 and 50 and the consequent vertical repositioning of main shaft 24 causes a substantial change in the orientation of all of the hydraulic control levers 20*a* through 20*e*.

Figure 5:
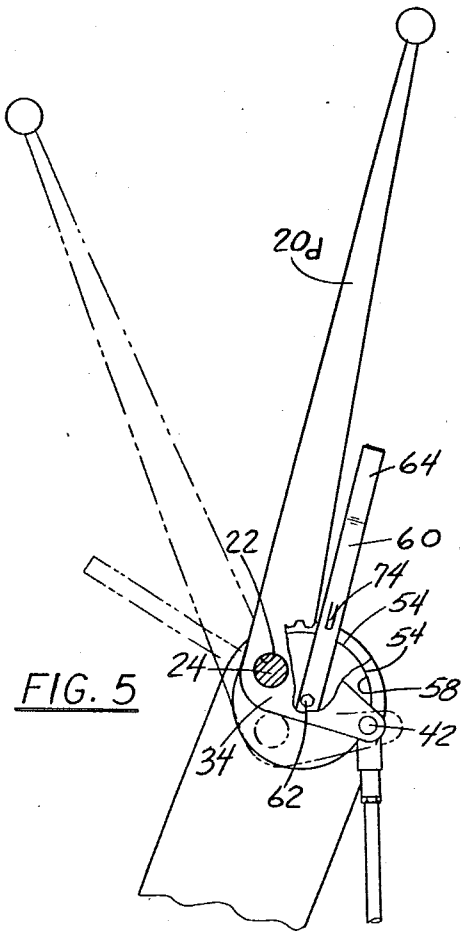
FIG. 5 is a right side elevation as in FIG. 3, but having a portion broken away.
Figure 4:
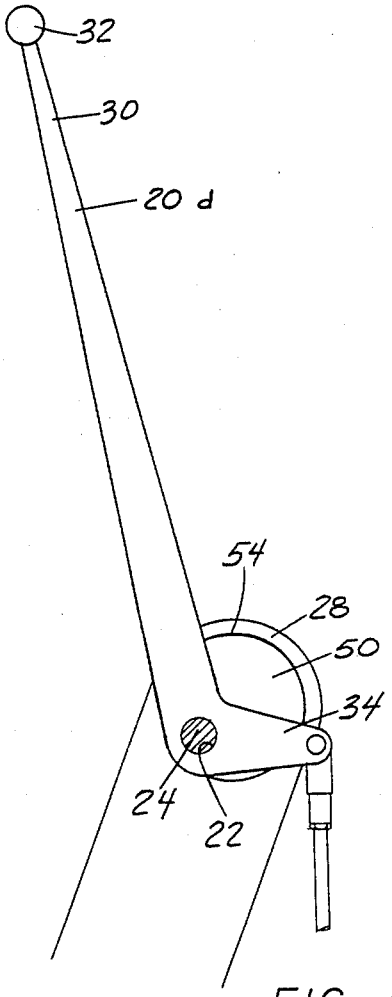
FIG. 4 is a sectional view taken along section 4—4 as indicated in FIG. 2 with levers 20*a*–20*c* and other background removed for clarity.
Figure 3:
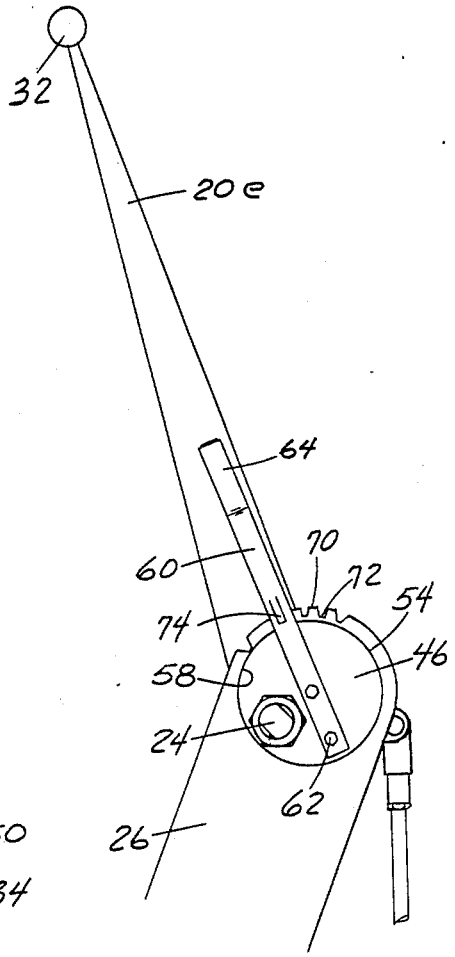
FIG. 3 is a right side elevation of FIG. 2 with levers 20*a*–20*d* and other background removed for clarity.

Thus, as plates 46 and 50 are rotated counterclockwise, for example, to the positions illustrated in FIGS. 3 and 4 and by phantom lines in FIG. 5, upper ends 30 of control levers 20*a* through 20*e* move toward the position of the operator sitting in seat 18. On the other hand, when plates 46 and 50 are rotated clockwise, upper ends 30 of the control levers move away from the position of the operator. Such movement can be minimal or very substantial, depending on the wishes of the operator.

An adjustment arm 60 is affixed to first plate 46 by bolts 62. Adjustment arm 60 is across plate 46 at or near its center and extends well beyond its circular edge 54 to a distal end 64 which serves as a handle for adjustment arm 60. The operator grasps distal end 64 and pulls or pushes it to rotate first plate 46. Second plate 50 rotates in tandem with first plate 46 by virtue of their attachment through main shaft 24.

First standard 26 has a semicircular top edge 70 which is parallel to the upper portion of circular edge 54 of first plate 46. Semicircular top edge 70 has upwardly-opening notches 72 spaced therealong. Adjustment arm 60 has a tab 74, which is a cut-out laterally projecting portion of the flat piece forming adjustment arm 60, positioned to engage a selected notch 72, depending on the desired position of adjustment of the range of motion of levers 20*a* through 20*e*.

Figure 2:
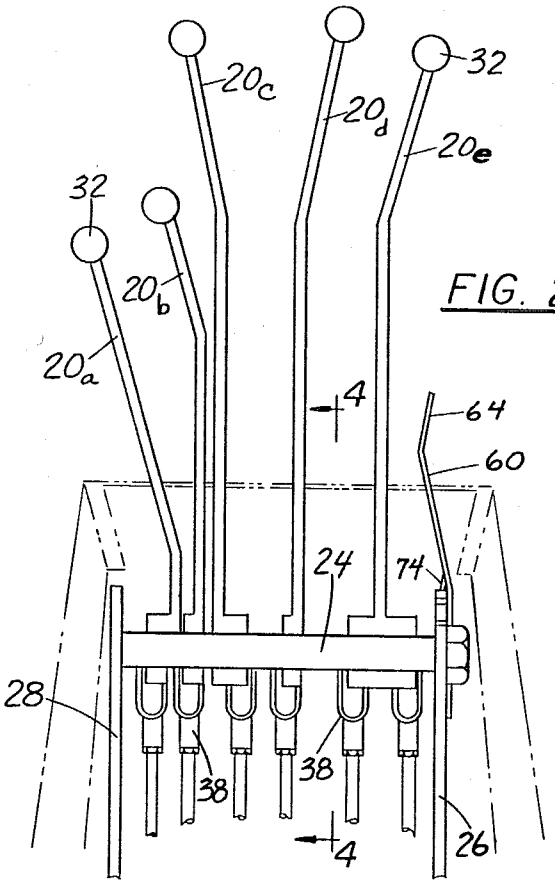
FIG. 2 is an enlarged fragmentary front elevation of the hydraulic control device of FIG. 1, with the housing partially shown in phantom lines to better illustrate working parts.

Adjustment arm 60 is preferably a flat piece of metal with some resilient characteristics (either inherent or by virtue of a spring-mounted connection) such that it may be pulled to the side to disengage tab 74 from notch 72. Such disengagement motion is to the right as viewed in FIG. 2. After adjustment arm 60 is disengaged in this manner, it may be moved fore or aft to adjust the position of the range of control lever motion, as previously explained. When adjustment arm 60 is released, tab 74 will again engage a notch 72 to hold the device in the chosen position of adjustment.

The device of this invention is preferably made using steel members and available connectors and parts, all as well known to those skilled in the art. Many variations are possible in the various elements and relationships shown and described herein.

While the principles of this invention have been described in connection with specific embodiments, it should be understood clearly that these descriptions are made only by way of example and are not intended to limit the scope of the invention.

What is claimed:

1. In an earth-moving equipment control device of the type with a plurality of levers having upper ends movable fore and aft for control and lower ends secured to upright links extending to valves, each lever pivotably mounted along a horizontal axis by a pivot mount near its lower end, the improvement comprising:

a pair of spaced upright supports;

a pair of axially aligned end members each movably mounted on one of the supports;

a main shaft secured to and extending between the end members, the levers attached thereto by their pivot mounts;

means to adjust the end members on the supports, their mountings and the main shaft arranged and positioned such that end member adjustment means moves the main shaft vertically, the adjustment means including: an adjustment arm affixed to and extending from one of the end members upwardly adjacent to one of the upright supports to a distal; interengaging means on the upright support and arm, between the end member and distal end, to interengage the arm and upright support in fixed relative positions; and the adjustment arm distal end being biased toward the upright support for engagement of the interengaging means and movable laterally away from the upright support to disengage the interengaging means, whereby adjustment moves the range of motion of the lever upper ends fore or aft to adjust for particular operators.

2. The control device of claim 1 wherein the interengaging means comprises a plurality of notches on the upright support on which said one end member is mounted, said notches being selectively engagable by the adjustment arm.

3. The control device of claim 2 wherein the interengaging means further comprises the arm having a laterally-projecting notch-engaging tab.

4. The control device of claim 1 wherein the movable mounting of each end member comprises means on the support for such end member limiting and defining the movement of the end member with respect to its support.

5. The control device of claim 4 wherein movement of the end members is through an arc.

6. The control device of claim 1 wherein each end member is rotatable with respect to its support about an axis parallel to the axis of the main shaft.

7. The control device of claim 6 wherein each end member is a plate having a circular edge and each support has an annular edge rotatably engaging the circular edge of the end member on such support.

8. In an earth-moving equipment control device of the type with a plurality of levers having upper ends movable fore and aft for control and lower ends secured to upright links extending to valves, each lever pivotably mounted along a horizontal axis by a pivot mount near its lower end, the improvement comprising:

a pair of spaced supports;

a pair of axially aligned plates each rotatably mounted on one of the supports for rotation about an axis parallel to the axis of the main shaft, each plate having a circular edge and each support having an annular edge rotatably engaging the circular edge of the plate on such support;

a main shaft secured to and extending between the plates, the levers attached thereto by their pivot mounts;

means to rotatably adjust the plates on the supports, their mountings and the main shaft arranged and positioned such that plate adjustment moves the main shaft vertically, whereby adjustment moves the range of motion of the lever upper ends fore or aft to adjust for particular operators.

9. The control device of claim 8 wherein at least one of the plates is substantially coplanar with the support on which it is rotatably mounted.

10. The control device of claim 8 wherein the means to rotatably adjust comprises an adjustment arm affixed to one of the plates and extending beyond the circular edge thereof.

11. The control device of claim 10 further including means to rotatably adjust to engage the adjustment arm and hold it in a selected position of adjustment, said means to engage being on the support to which said one plate is mounted.

12. The control device of claim 11 wherein:

the support to which the plate with the adjustment arm is mounted has a top edge parallel to the circular edge of the plate; and the holding means engages the top edge.

13. The control device of claim 12 wherein the holding means comprises a plurality of notches along the top edge which are selectively engagable by the adjustment arm.

14. The control device of claim 13 wherein:

the plate to which the adjustment arm is attached is substantially coplanar with the support on which it is rotatably mounted;

the adjustment arm is a flat strip against the coplanar plate and support, overlying the notched top edge of the support; and the strip has a tab projecting therefrom to engage one of the notches.

* * * * *

UNITED STATES PATENT AND TRADEMARK OFFICE

CERTIFICATE OF CORRECTION

PATENT NO. : 4,794,813
DATED : January 3, 1989
INVENTOR(S) : Thomas R. Brown, Ronald Natzke, Richard H. Logan It is certified that error appears in the above-identified patent and that said Letters Patent is hereby corrected as shown below:

In column 2, line 46, change "the the" to --the--.

In column 3, line 7, delete "the most".

In column 6, line 10, after "distal" insert --end--.

In claim 11, line 2, delete "to rotatably adjust".

Signed and Sealed this

Second Day of May, 1989

*Attest:*

DONALD J. QUIGG

*Attesting Officer*

*Commissioner of Patents and Trademarks*